US008104527B1

(12) United States Patent
Konda et al.

(10) Patent No.: US 8,104,527 B1
(45) Date of Patent: Jan. 31, 2012

(54) METHOD AND APPARATUS FOR MAKING AN AWNING STRUCTURE

(76) Inventors: Srinivas Konda, Colleyville, TX (US); Katherine Ruth Konda, Colleyville, TX (US)

( * ) Notice: Subject to any disclaimer, the term of this patent is extended or adjusted under 35 U.S.C. 154(b) by 260 days.

(21) Appl. No.: 11/242,513

(22) Filed: Oct. 3, 2005

(51) Int. Cl.
*E04F 10/00* (2006.01)
*F04B 1/34* (2006.01)

(52) U.S. Cl. ..... 160/83.1; 52/74; 52/653.2; 52/655.1

(58) Field of Classification Search ..... 160/83.1, 160/66, 58.1, 54, 57, 45; 52/74, 655.1, 653.1, 52/656.9, 653.2; 403/171, 176, 231, 403
See application file for complete search history.

(56) References Cited

U.S. PATENT DOCUMENTS 1,787,167 A * 12/1930 Purdy ..... 403/58
1,926,609 A * 9/1933 Bauschard ..... 52/74
2,565,545 A * 8/1951 Card ..... 160/58.1
2,930,088 A * 3/1960 Sims ..... 52/76
3,234,697 A * 2/1966 Toti et al. ..... 52/75
3,375,029 A * 3/1968 Frye et al. ..... 403/230
3,386,590 A * 6/1968 Gretz ..... 211/189
3,973,854 A * 8/1976 Gilbo et al. ..... 403/170
4,368,998 A * 1/1983 Pestoor ..... 403/171
4,422,491 A * 12/1983 Cusick, III ..... 160/58.1
4,630,550 A * 12/1986 Weitzman ..... 108/155
4,665,671 A * 5/1987 Sarvis ..... 52/222
4,688,358 A * 8/1987 Madray ..... 52/93.2
4,692,847 A * 9/1987 Gandy ..... 362/152
4,768,317 A * 9/1988 Markham ..... 52/74
4,796,393 A * 1/1989 Toti ..... 52/76
4,888,921 A * 12/1989 Markham ..... 52/63
RE34,022 E * 8/1992 Davis ..... 52/693
5,265,740 A * 11/1993 Hodsden et al. ..... 211/187
5,590,974 A * 1/1997 Yang ..... 403/327
5,685,662 A * 11/1997 Rollin et al. ..... 403/231
5,906,080 A * 5/1999 diGirolamo et al. ..... 52/243.1
6,082,070 A * 7/2000 Jen ..... 52/650.3
6,247,869 B1 * 6/2001 Lichvar ..... 403/205
6,672,014 B1 * 1/2004 Jones ..... 52/92.2
6,968,962 B2 * 11/2005 Toma ..... 211/182
2004/0049993 A1 * 3/2004 Saldana ..... 52/90.2

* cited by examiner

*Primary Examiner* — Blair M Johnson
*Assistant Examiner* — Jaime F Cardenas-Garcia
(74) *Attorney, Agent, or Firm* — John F. Bryan

(57) ABSTRACT

A method and apparatus for joining angularly oriented side planar members into an otherwise orthogonal awning frame of open ended side plane and transverse members joined by fitted right angle connectors has the angularly oriented member cut to length at end angles that provide a flush fit to the side plane members at transverse member connections and lengths of formed right angle section material, cut at the same flush fitting angles as the tubing end angle cuts, for fastening to inwardly facing surfaces of the planar and transverse members, so as to present a smooth exterior surface for supporting an awning cover.

5 Claims, 5 Drawing Sheets

METHOD AND APPARATUS FOR MAKING AN AWNING STRUCTURE

FIELD OF THE INVENTION

The present invention relates to awning frame structures, which, with other components, provide support for an awning cover and more particularly, to such structures formed from tubular materials.

BACKGROUND OF THE INVENTION

Awnings are in popular use over residential and commercial windows to shield and shade the windows without obstructing the view. Awnings typically have a structural frame formed by connection of a plurality of load bearing members, which are spaced apart in a manner to provide support for the awning covering material. Mounting brackets are typically provided to affix the frame and covered awning assembly in position over a designated wall opening. Awnings are made in a variety of forms, all well known in the prior art.

Awnings are especially useful to shelter windows and entranceways and, in commercial buildings, may also bear signage. One common awning variety, as seen from the side, has the shape of a right triangle, with a vertical leg against the wall, a horizontal leg projecting outwardly and a downwardly inclined member to provide a run-off angle. Two such sides are connected by at least two horizontal, transverse members, so as to form a structural support for the awning. As viewed from the front, such awning frames may be made to any suitable width by lengthening the transverse members and adding inclined members as needed.

Awning frames are generally made of steel or aluminum and cannot have external projections that would chafe and fray holes in the cover fabric. As a result, welded construction has traditionally been preferred. Tubular steel has long been the material of choice, preferred for its stiffness, lightness and ease of welding as compared to other structural sections and materials. Many awning frames, especially larger ones, are fabricated by welding the members together in a shop remote from the place of installation and trucking them to their installation sites. Although this is an accepted practice, such awning frames are expensive to manufacture, heavy to carry and install, are bulky and difficult to maneuver and have no ability to be disassembled. It is almost impossible for awnings of this type to be mass-produced and sold in the mass market, because their bulk precludes shipment or holding in inventory. The lightness of aluminum tubing makes it a desirable alternative material but, it requires more specialized welding skills and, a welded aluminum awning frame, even though lighter, has the same generic limitations.

Marketing awnings in kit form requires the provision of hardware to connect the frame members. Various orthogonal connectors for tubular members, such as disclosed in Pestoor's U.S. Pat. No. 4,368,998 and others, are known in the prior art. However, awning frames vary so widely in height, projection and run-off angle, that making them for on-site assembly would require stocking an unpredictable variety of angular connectors. The frame member connections must also be such that the exterior frame surfaces are smooth and non-chafing. Although a connector might be envisioned and manufactured for a given junction angle, it would be an unreasonable expense to provide an inventory of such connectors for all junction angles. These factors have defeated past efforts to provide tubular frame awning kits for a broad range of dimensional requirements, except by field welding the structural members.

A first object of the present invention therefore, is to enable the assembly of tubular members for making an awning structure having any desired given height, projection and run-off angle. A second object is to reduce the labor costs involved in making the component parts this awning structure. A third object is to reduce the inventory costs entailed in providing such awning structures as kits. A fourth object is to improve the packaging of preformed components of this awning structure for handling and shipping and yet another object is to simplify on-site assembly of this awning structure.

SUMMARY OF THE INVENTION

The present invention contemplates methods and apparatus for providing an awning structure in a packagable kit form. The invention relates to and employs some steps and apparatus well known in the arts and therefore, not the subject of detailed discussion herein. The present invention discloses methods and apparatus for an awning structure, responsive to the above objects.

The salient feature of the present invention is a method for joining angularly inclined members, which provide the run-off angle, into an otherwise orthogonal awning frame. The frame is preferably made of open-ended square tubing members, wherein orthogonal, vertical, horizontal and transverse member connections are made with internally fitted right angle connectors by friction or adhesives, so as to present a smooth exterior surface. The inclined members are angularly cut for a flush fit to the orthogonal members at the awning sides, and at intermediate planes, as required to support the awning cover. Right and left hand lengths of right angle cross-section material are cut at the same angles as are the ends of the inclined members and fasten to inwardly facing surfaces of the orthogonal and angular members at their intersection, so as to also present a smooth supporting exterior surface for an awning cover.

BRIEF DESCRIPTION OF THE DRAWINGS

The accompanying drawings are incorporated into the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
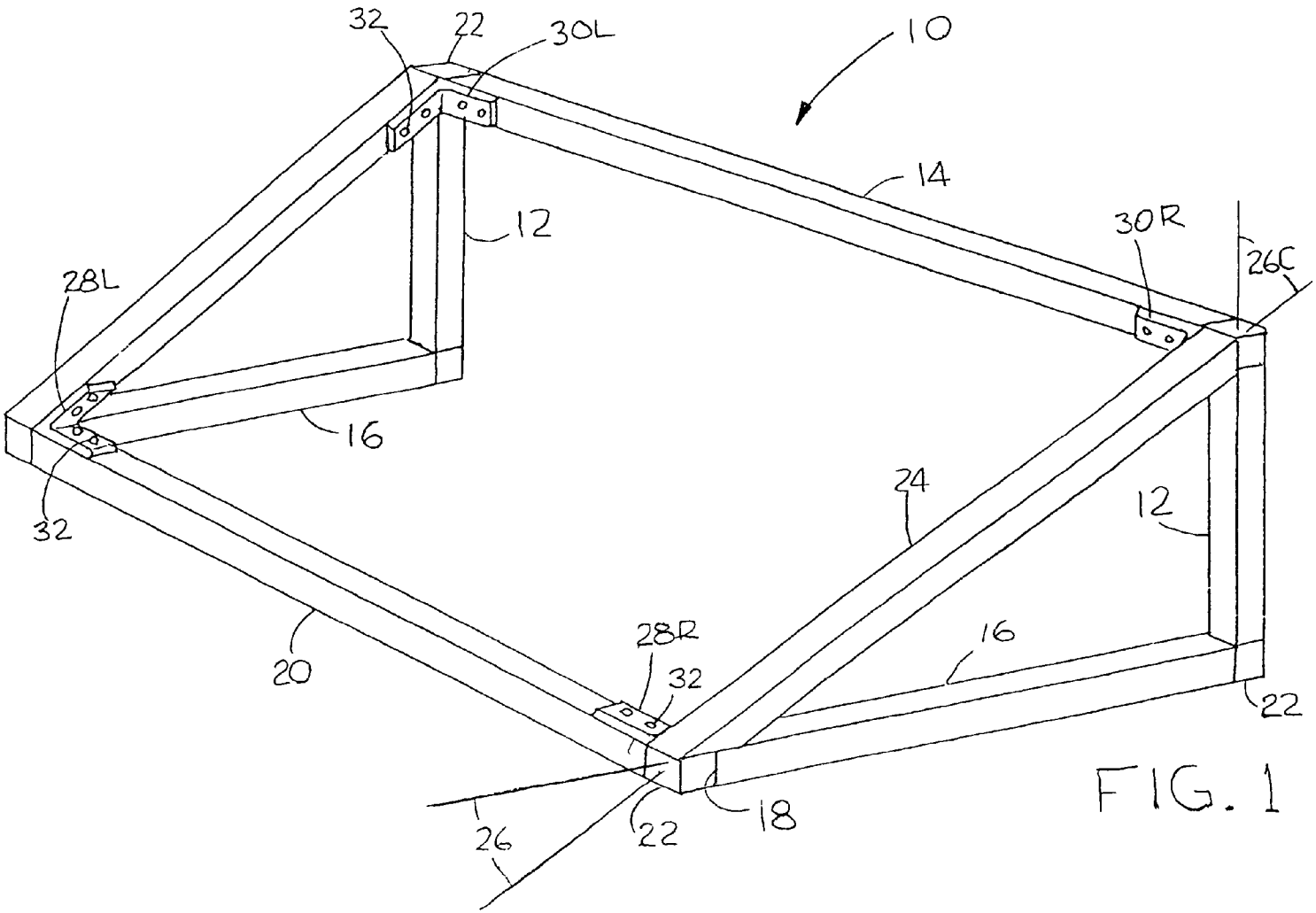
FIG. 1 is a perspective view showing a preferred embodiment of an awning frame utilizing the apparatus and method of the present invention.

The present inventions are described in the following by referring to drawings of examples of how the inventions can be made and used. In these drawings, reference characters are used throughout the views to indicate like or corresponding parts. The embodiments shown and described herein are exemplary as being capable of entirely mechanical assembly, without welded connections, so as to be suitable for sale as a kit. Some details are well known to those skilled in the art, and as such are neither shown nor described.

Figure 2:
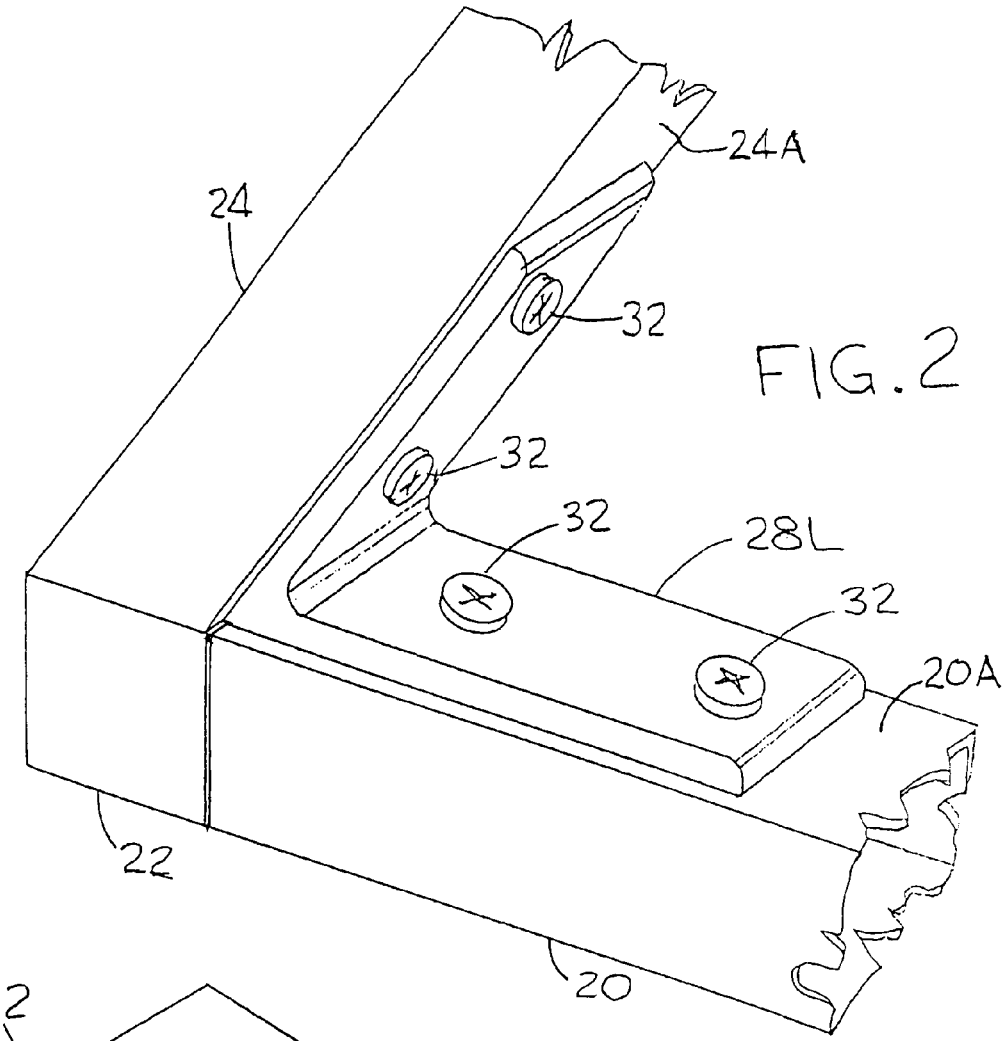
FIG. 2 shows an enlarged view of an angular connection of the embodiment of FIG. 1.

FIGS. 1 and 2 are perspective and detail views of a preferred embodiment of tubular awning frame 10 utilizing the present invention, so as to be suitable for sale in kit form. Square or rectangular cross-section tubing is a preferred material for the awning structural members, because it is light, rigid and easily cut to length. Vertical wall attaching members 12 are joined to transverse wall attaching member 14, to form the upper edge of awning structure 10 as shown. Horizontal projection members 16 extend away from the wall, perpendicular to members 12, and are joined to the lower ends thereof. The outer ends 18 of members 16 are spanned by transverse member 20 to form the outer edge of awning frame 10. Orthogonal, right angle connectors 22 are provided to fit tightly in the open, square cut tubing ends, and are retained by friction or adhesion, to make connections in the generally orthogonal frame. This type of connection is preferred because bolt heads, or any protrusion, at the exterior surfaces of frame 10 will chafe and ultimately tear the unshown awning cover. This being the case, any tube member connecting hardware should only be at inwardly facing surfaces of the tubing frame, as described below in the present invention.

The run-off angle 26 of angularly inclined cover support members 24, essential to the function of an awning, varies according to the awning depth and projection, that is to say, the length of vertical members 12 and projection members 16. Cover support members 24 are cut at acute end angles 26 and 26C for a flush fit to the orthogonal members 12 and 16 and orthogonal connectors 22, in the plane of the awning sides and, if needed to support the awning cover, at intermediate planes. The present invention provides acute angular connectors 28L, 28R, 30L and 30R for the foregoing purpose. As shown below, lengths of right angle cross-section material 28R, 28L and 30R, 30L are cut on the same angles as the end angles 26 or 26C of the acute angularly inclined cover support members 24 and then drilled for connecting screws 32. Made in this manner, right and left hand section lengths 28R, 28L and 30R, 30L, match the inwardly facing surfaces 20A and 24A or 14A and 24A of cover support members 24 and horizontal transverse members 14 and 20, so as to connect these frame members, and present a smooth surface for supporting an awning cover when fastened as shown in FIG. 2.

Figure 3:
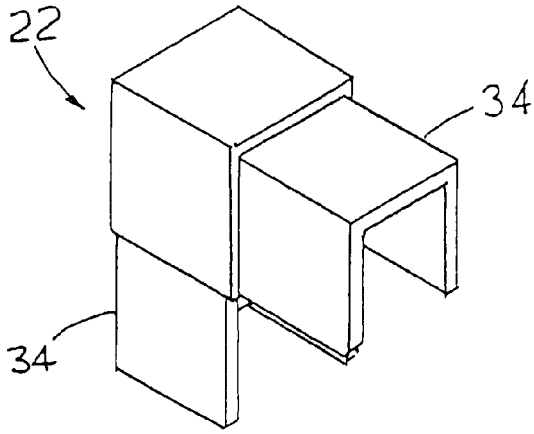
FIG. 3 (PRIOR ART)
FIG. 3 shows an orthogonal connector as is used for FIG. 1.

FIG. 3 shows prior art orthogonal tubing connector 22, commercially available as an injection molded hollow, or open centered, plastic part. Connectors 22 have square cross-section ends 34, sized to fit tightly into open, square cut tubing ends so as to make corners for an orthogonal structure.

Figure 4:
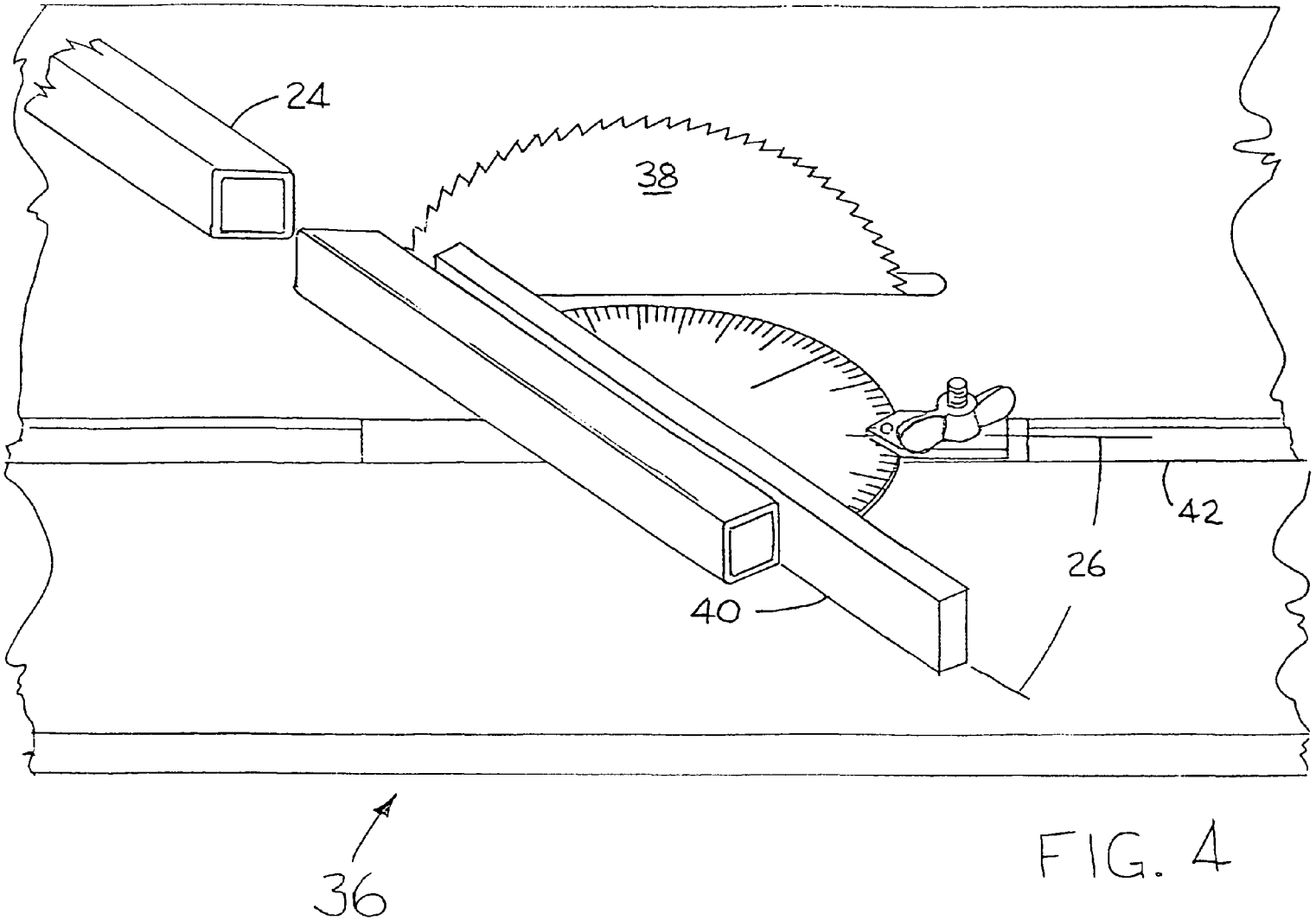
FIG. 4 shows a method of cutting the angularly inclined members.
Figure 5:
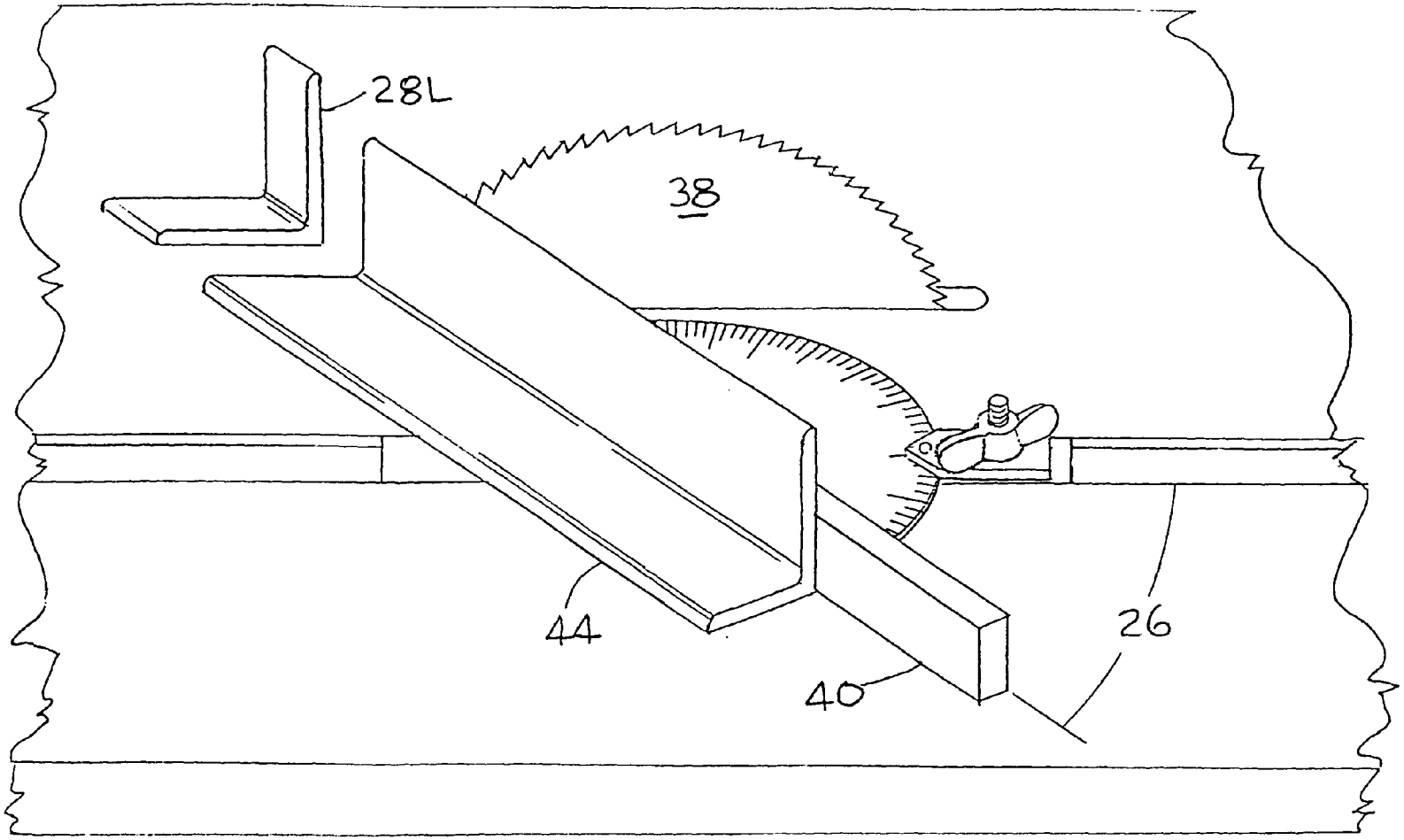
FIG. 5 shows the method of cutting a length of formed angle sections to provide the connector of FIG. 2.
Figure 6:
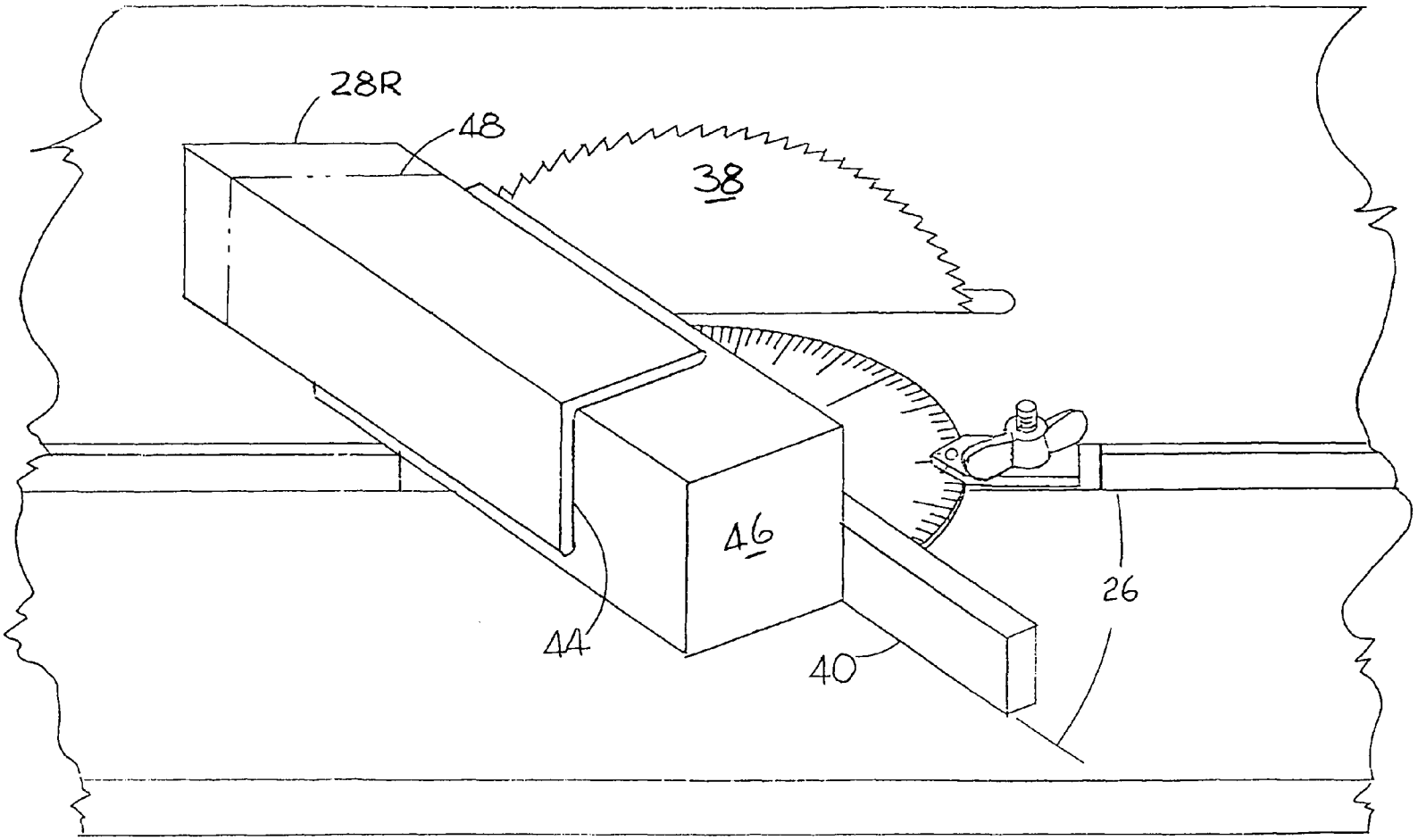
FIG. 6 shows the method of cutting the length of formed angle sections to provide an opposite hand connector.

FIGS. 4, 5 and 6 are perspective views, showing a manner of miter cutting cover support members 24 to fit at run-off angle 26 and making angular connectors 28L, 28R and 30L, 30R. Circular saw table 36 is equipped with saw blade 38 and adjustable fence 40, sliding in guide groove 42, set at run-off angle 26. Cover support member 24 is shown prior to being cut to length at angle 26C, complementary to run-off angle 26. FIG. 5 is a perspective view of circular saw table 36, with the adjustment of fence 40, unchanged from FIG. 4, for the purpose of cutting an axial length of right angle cross-section material 44 to make angular connector 28L. FIG. 6 again shows circular saw table 36 set for angle 26 and, in this case, the manner of using square cross-section block 46 to cut opposite hand angular connector 28R at cut-line 48. The operations for making angular connectors 30L and 30R are as is illustrated in FIGS. 4, 5 and 6, with adjustable fence 40 re-set for making cuts at the complementary angle 26C.

The restrictive description and drawings of the specific examples above do not point out what an infringement of this patent would be, but are to provide at least one explanation of how to use and make the invention. Materials may be substituted for those described and parts may be added or altered but not withstanding, the limits of the invention and the bounds of the patent protection are measured by and defined in the following claims.

We claim:

1. A method, for an awning frame constructed of square cross-section tubing having orthogonally connected vertical and horizontal side members and upper and outer transverse members, for making and joining angularly inclined side members at acute angles into the otherwise orthogonal awning frame at the upper and outer edges thereof to provide a run-off angle, comprising the steps of:

making the inclined members by cutting square cross-section tubing to length at acute end angles that fit flush to the horizontal and vertical side members at the upper and outer transverse member connections therewith;

making right and left hand angular connectors by cutting right angle cross-section material to axial lengths approximately equal to the square cross-section tube width and at the same flush fitting acute angles as the angularly inclined member end angles;

drilling holes for fastener connections in the angular connectors; and joining the angularly inclined members to the transverse members at their upper and outer edge connections with the horizontal and vertical side members by mutually fastening the respective right or left hand angular connector to inwardly facing surfaces of the inclined member and the transverse member so as to provide smooth exterior surfaces for supporting an awning cover.

2. A method for providing a kit for an awning structure having a run-off angle and an otherwise orthogonal awning frame of vertical and horizontal side members and transverse members, for assembly without welded connections, comprising the steps of:

cutting square tubing to the lengths required for the vertical and horizontal side members and transverse members;

providing orthogonal connectors sized to fit tightly into the square tubing ends for joining the vertical and horizontal side plane members and connecting the transverse members to the side plane members;

cutting square tubing to length at acute end angles so as to provide angularly inclined run-off angle members having a flush fit against the side members and the orthogonal transverse member connections;

making angular connectors by cutting right angle cross-section material to right and left hand axial lengths approximately equal to the square tubing width, at the same flush fitting acute angles as the tubing end angles; and;

drilling holes for fastener connections in the angular connectors for joining the angularly inclined members to the transverse members by fasteners mutually connecting inwardly facing surfaces of both to the appropriate right or left angular connector on assembly so as to provide a smooth exterior surface for supporting an awning cover.

3. Apparatus in a kit for an awning frame structure to be attached to a vertical surface over an opening therein, comprising:

a mechanically assembled, unwelded orthogonal structure of square tubular side members having distal end and proximal ends, with the proximal ends to be connected so that the side members will project outwardly from and upwardly along, the vertical surface at each side of the opening therein, and transverse tubular members of a length to be connected to the distal ends, so as to extend across the width of said opening;

orthogonal connectors fitting the tubular member ends for joining the upwardly and outwardly projecting side member proximal ends together and connecting each of the side member distal ends to one of the transverse members;

two angularly inclining, square tubular members, for connecting the distal ends of the upwardly and outwardly projecting tubular members at each side of the opening, cut to length at acute end angles so as to fit flush against the orthogonal connectors and the side members at the side member distal ends;

lengths of right angle cross-section material, cut to length as right and left hand angular connectors, at the same flush fitting acute angles, and having drilled holes for screw connection to the angularly inclining and transverse members respectively; and fasteners for joining the right or left angular connectors to the respective angularly inclining members and transverse members at the inwardly facing surfaces thereof, so as to provide connections with smooth exterior surfaces for supporting an awning cover.

4. A kit for an awning frame structure to be attached to a wall surface over an opening therein, comprising:

two first square tubular members of a given length, having distal and proximal ends, for vertical attachment to the wall surface along each side of the opening;

two second square tubular members of a second given length, having distal and proximal ends, for horizontally projecting attachment, perpendicular to the wall surface at each side of the opening;

two third square tubular members of an equal length appropriate to spanning the opening in the wall surface and transversely connecting the distal ends of the first and second members respectively;

orthogonal connectors sized to fit snugly within the square tubular members, for joining the proximal ends of the first and second tubular members at each side of the opening and for joining the respective distal ends thereof to one of the third tubular members;

two fourth square tubular members cut to length at acute end angles that will fit flush against said first and second members and orthogonal connectors at the distal ends thereof;

acute angular connectors made of right and left hand lengths of right angle cross-section material cut at the same flush fitting end angles, with drilled holes for fastener connection to the third and fourth tubular members; and fasteners for joining the appropriate right or left hand section lengths to the third and fourth tubular members respectively, at the inwardly facing surfaces thereof, so as to provide a smooth exterior surface for the awning frame structure.

5. A method for joining angularly inclined side plane members to transverse members at junctures thereof with orthogonal horizontal and vertical side plane members in a square tubing awning structure, comprising the steps of:

cutting square tubing to the lengths required to form the vertical and horizontal side plane members and the transverse members;

providing orthogonal connectors sized to fit tightly into the square tubing ends and connecting each of the vertical side plane members to one of the horizontal side plane members therewith;

connecting the transverse members to the unconnected ends of the side plane members with orthogonal connectors;

cutting square tubing to length at acute end angles to provide angularly inclined members fitting flushly against the side members and orthogonal connectors at the connections of transverse members therewith;

making acute angular connectors by cutting right angle cross-section material to right and left hand lengths approximately equal to the square tubing width, and at the same flush fitting angles as the inclined member end angles;

drilling holes for fastener connections in the right angle cross-section lengths; and joining the angularly inclined members to the transverse members by fasteners mutually connecting inwardly facing surfaces of both members to the appropriate right or left hand acute angular connector so as to provide a smooth exterior surface for supporting an awning cover.

* * * * *